United States Patent [19]

Prince et al.

[11] Patent Number: 4,626,058

[45] Date of Patent: Dec. 2, 1986

[54] CONNECTOR BOX FOR COAXIAL CABLE

[75] Inventors: Thomas F. Prince, Milton; Julian J. Bishop, Belmont, both of Mass.

[73] Assignee: Ark-Les Corporation, Watertown, Mass.

[21] Appl. No.: 782,223

[22] Filed: Sep. 30, 1985

[51] Int. Cl.[4] ..... H01R 4/24

[52] U.S. Cl. ..... 339/97 P; 339/177 R

[58] Field of Search ..... 339/97 P, 99 R, 177 R

[56] References Cited

U.S. PATENT DOCUMENTS

| | | | |
|---|---|---|---|
| 4,391,484 | 7/1983 | Foederer | 339/97 P |
| 4,533,193 | 8/1985 | Blackwood | 339/97 P |
| 4,533,197 | 8/1985 | Prince et al. | 339/97 R |

*Primary Examiner*—Joseph H. McGlynn

*Attorney, Agent, or Firm*—Sylvia L. Boyd; H. Eugene Stubbs

[57] ABSTRACT

A connector box for coaxial cable includes a metal shell made from a stamping and folded into a box shape, a spacer structure of non-conductor, an inner connector and a cover. Insulation displacement slots in the shell wall with sharpened vee-shaped entries and in-turned edges engage a cable outer conductor. A stepped passage in the spacer structure positions the cable during insertion. Insulation displacement slots with vee-entries in the inner connector are aligned with those of the shell and engage the inner conductor of the cable.

21 Claims, 5 Drawing Figures

CONNECTOR BOX FOR COAXIAL CABLE

INTRODUCTION

This invention relates to devices for interconnecting coaxial cables. Devices for interconnecting cables are known, but there continues to be a need for effective interconnection devices, especially for devices that are inexpensive to make and easy to use.

BRIEF SUMMARY OF THE INVENTION

The invention features a shell formed by progressive stamping from sheet metal stock and bent to the form of an open box with a floor and a side wall perpendicular thereto, the shell side wall having a free standing edge spaced from the floor. A spacer structure is made of dielectric material and fitted within the shell, the spacer including a wall adjacent the shell wall. An inner connector element formed by progressive stamping from sheet metal stock, is supported by the spacer structure within the shell without making electrical contact with the shell, and provides a wall perpendicular to the floor, the inner connector wall having a free standing edge spaced away from the floor. The shell has insulation displacing slots in its wall entering from the free standing edge thereof and sized to cut through the sheath of a cable and engage the outer conductor of the cable. The spacer structure has passages in its wall aligned with the shell slots and the inner connector element has insulation displacing slots aligned with the displacement slots in the shell and sized to out through the inter-conductor dielectric and engage the inner conductor of the cable.

The invention may also include: stepped passages in the spacer structure with an outward portion sized to receive the sheath and the inward portion sized to receive the inter-conductor dielectric but not the sheath; sharp, vee-shape entering sections for the shell slots and vee-shaped entering sections for the slots of the inner connector element; shell wall insulation displacing slots having a portion bounded by an inward turned edge of the shell wall; a cover held in place in its assembled position by tabs extending from the shell wall and bent over the cover; a cable retaining portion of the cover extending toward the floor for holding an attached cable in place; and a shell side wall made from a plurality of sections bent up from the floor, the sections being held in position with respect to one another by tabs extending from one section and bent around another; a spacer structure made of material with a dielectric constant equal to that of the cable inter-conductor dielectric and a wall lip portion defining the inward portion of the stepped passage and having a thickness equal to the resultant thickness of the cable inter-conductor dielectric.

DETAILED DESCRIPTION

Connector 10, according to the invention, provides interconnections for coaxial cables such as 12 which have an inner conductor 14, an inter-conductor dielectric 16, an outer conductor 18, and an outer protective sheath 20. Interconductor dielectric 16 has an annular cross section; the dielectric material has a resultant thickness, defined as the difference between the external radius of the dielectric and the radius of the inner conductor (which is the internal radius of the dielectric).

Figure 1:
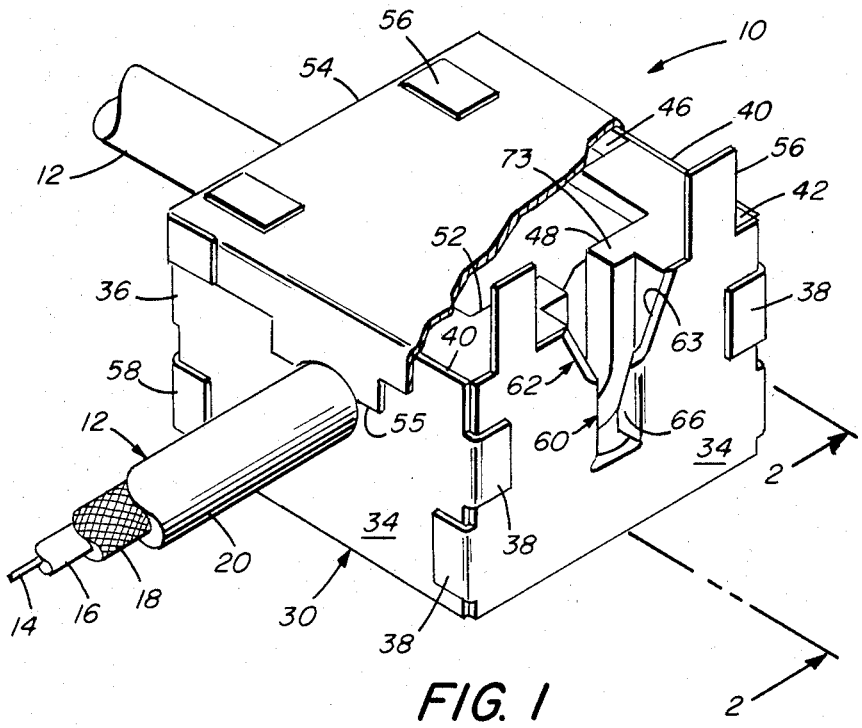
FIG. 1 shows in perspective view a connector box according to the invention with a portion of the cover removed to reveal interior details.
Figure 2:
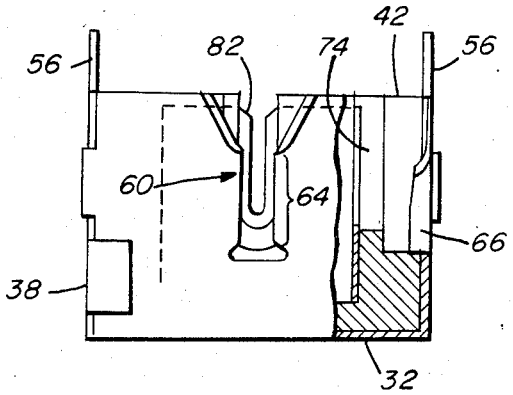
FIG. 2 shows in elevation view the connector box of FIG. 1 without its cover and partially sectioned to reveal interior detail.
Figure 3:
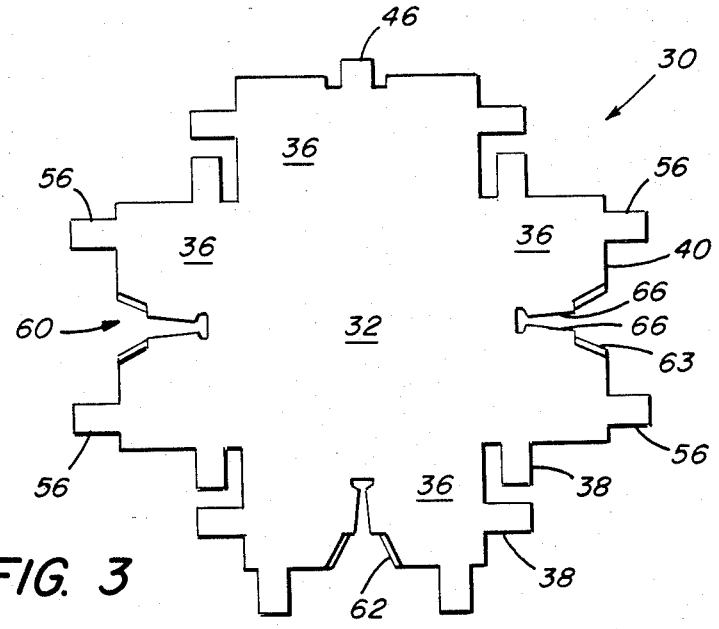
FIG. 3 shows the stamping before bending for the shell of the connector box of FIG. 1.
Figure 4:
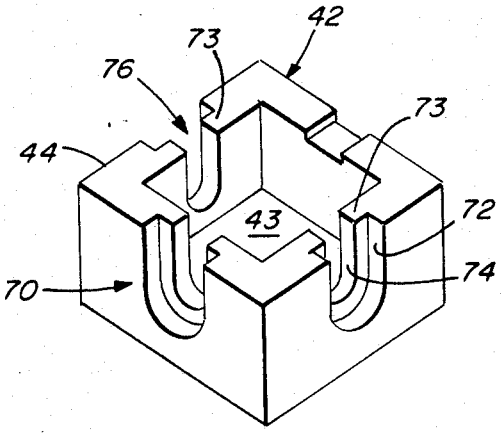
FIG. 4 shows the spacer structure of the connector box of FIG. 1.
Figure 5:
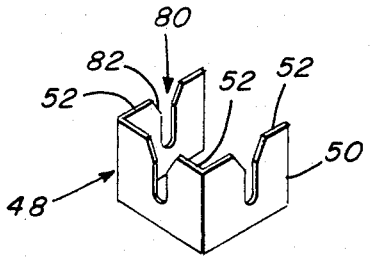
FIG. 5 shows the inner connector of the connector box of FIG. 1.

Connector 10 includes shell 30, made from sheet metal stock as shown in FIG. 3, by progressive stamping to the form of an open box as shown in FIG. 1, with floor 32, and side wall 34 perpendicular thereto. Side wall 34 is formed by sections 36 bent up from floor 32 and held in position by tabs 38 extending from one section and bent around another. Side wall 34 thus has a lower boundary directly connected to floor 32 and an upper boundary spaced from floor 32 which includes free standing edge 40 not directly connected to any structure. Spacer structure 42, made of dielectric material, is fitted within shell 30. Spacer structure 42 has a wall 44 positioned adjacent to wall 34 of shell 30, and a bottom wall 43 positioned adjacent to floor 32 of shell 30, and is held in place within shell 30 by tab 46. Inner connector 48, formed of sheet metal stock by stamping, is supported by spacer structure 42 within but not making electrical contact with shell 30, and provides wall 50 perpendicular to floor 32. Wall 50 has a boundary spaced from floor 32 which includes free standing edge 52 not directly connected to any structure. Cover 54 in its assembled position (FIG. 1) fits over the open side of shell 30 and is held in place by tabs 56 extending from shell wall 34 through slots in cover 54 and then bent over. Cable retaining portion 55 extends toward floor 2, holding cable 12 in place.

Shell wall 34 has insulation displacing slots 60 with vee-shaped entry sections 62 having sharp edges 63, formed by coining, opening from shell wall edge 40. Beneath the vee-shaped section, slots 60 have a portion 64 bounded by inward turning edge 66 of shell wall 34. Slots 60 are sized to cut through the sheath 20 of cable 12 and engage with electrical contact outer conductor 18.

Spacer structure 42 has stepped passages 70 through its wall 44 aligned with slots 60. Outward portion 72 of passage 79 is sized to receive sheath 20 of cable 12; inward portion 74 is sized to receive inter-conductor dielectric 16 but not sheath 20. Inward portion 74 of passage 70 is defined by a lip 73 of spacer structure 42; lip 73 advantageously has a thickness equal to the resultant thickness of the cable inter-conductor dielectric. The bottom wall 43 of the spacer structure advantageously has a thickness equal to the result thickness of the cable inter-conductor dielectric.

Inner connector 48 has insulation displacement slots 80 with vee-shape entrance portion 82, aligned with slots 60 and passages 70 and sized to cut through inter-conductor dielectric 16 and engage inner conductor 14. Inner connector 48 is recessed within the spacer by a distance equal to the resultant thickness of the cable inter-conductor dielectric.

The operation of the connector box is as follows. Prior to the installation of cables to be connected, sections 36 of shell 30 have been bent up perpendicular to floor 32, and tabs 38 have been bent around to stabilize the box shape of the shell. Tabs 56, however, remain extending upwards away from floor 32. Spacer structure 42 is in place within shell 30 held by bent tab 46, and inner connector is within the spacer structure, held by an interference fit. The cover is formed but unattached to the shell. The end of each cable to be connected with the connector box is prepared by cutting it with a squared end and then removing, preferably with a stripping tool, the outer conductor and sheath to a distance about ¼ inch back from the end of the cable.

The cable is then positioned with the cut edge of the sheath against the step in the passage through the spacer structure (lip 73) and the sheath resting on the sharp edge of the vee-shaped portion of the insulation displacing slot of the shell. The sheath of the cable will be in the wider portion of the passage, the stripped part of the inter-conductor dielectric will be in the narrower portion of the passage and on or immediately above the entrance vee-shaped portion of the displacement slot of the inner connector element. The cable is then pressed downward into the slots. As this progresses the sharp vee-shaped portion of the shell slot cuts through the sheath; then as the cable is advanced further the inward turned edge of the slot pries the cut wider to expose an area of the outer conductor which engages and makes electrical contact with the edge of the slot. As the sheath is cut and exposed as described, the inter-conductor dielectric is advanced into the slot of the inner connector element which cuts through the dielectric and engages the inner conductor. The insertion operation is very simply done by a finger push with the step in the spacer providing guidance for the motion.

When the cables to be interconnected have been thrust into their slots, the inner conductors are securely connected through the inner connector element and the outer conductors are securely connected through the shell. The cover is then put on over the shell, closing the box and holding the cable in place with the cable retaining portions 55. The tabs 56 are then bent over to lock the cover in place.

The connector box as described above is inexpensive to manufacture because the parts are simple and formed with inexpensive operations. Further the connection of cables is extremely fast and easy, requiring only a conventional cable stripping tool. The turned-in edges of the displacement slots in the shell are particularly advantageous in making contact with cables where the outer conductor is a sparsely woven mat. The box also extends the shielding effect of the outer conductor around the whole junction region thus minimizing electrical pick-up or emission or RFI.

The wall thickness, lip thickness and dielectric constant of spacer structure 42 may be selected to advantageously establish the impedance matching characteristics of the connector. Making of the spacer structure of the same material as the inter-conductor dielectric of the cable or of material with the same dielectric constant and making the thickness of the wall lip portion of the spacer structure equal to the resultant thickness of the inter-conductor dielectric is advantageous. The inner connector may be recessed from the cover and from the shell by a distance equal to the resultant thickness of the inter-conductor dielectric.

Modifications of the described embodiment will be evident to those skilled in the art of making connectors, and the claims are not intended to be limited to the specific embodiment described.

What is claimed is:

1. For interconnecting coaxial cable having an inner conductor, an inter-conductor dielectric, an outer conductor, and an outer protective sheath, a connector box comprising in combination a shell formed by progressive stamping from sheet metal stock and bent to the form of an open box with a floor and a side wall perpendicular thereto, said sheet wall having a free standing edge spaced from said floor, a spacer structure made of dielectric material and fitted within said shell, said spacer including a wall adjacent said shell wall, an inner connector element formed by progressive stamping from sheet metal stock, supported by said spacer structure within said shell without making electrical contact with said shell, and providing a wall perpendicular to said floor, said inner connector wall having a free standing edge spaced from said floor, and a cover held in place in its assembled position by tabs extending from said shell wall and bent over said cover, said shell having insulating displacing slots in said shell wall entering from the free standing edge thereof and sized to cut through the sheath of said cable and engage the outer conductor of said cable, said spacer structure having passages in its wall for receiving said cable, said passages being aligned with said shield insulation displacement slots, and said inner connector having insulation displacing slots in said inner connector wall entering from the free standing edge thereof and sized to cut through said inter-conductor dielectric and engage said inner conductor, said inner connector slots being aligned with said shell slots and said passages, said passages being stepped with an inward portion smaller than an outward portion, said outward portion being sized to receive said sheath and said inward portion being sized to receive said inter-conductor dielectric but not said sheath, said shell wall insulation displacing slots having a vee-shape entry section opening to said shell wall free standing edge, said inner connector wall insulation displacing slots having a vee-shape entrance portion opening to said inner connector wall free standing edge, said shell vee-shaped portion being bounded by sharp edges of said shell wall, said shell wall insulation displacing slots having a portion bounded by an inward turned edge of said shell wall, said cover including a cable retaining portion extending toward said floor for holding an attached cable in place, said side wall being made from a plurality of sections bent up from said floor, said sections being held in position with respect to one another by tabs extending from one section and bent around another.

2. A connector box as claimed in claim 1, wherein said spacer structure is made of material with a dielectric constant equal to that of the cable inter-conductor dielectric, said spacer structure providing a lip portion defining said passage inward portion, said lip portion thickness being equal to the resultant thickness of the cable inter-conductor dielectric.

3. For interconnecting coaxial cable having an inner conductor, an inter-conductor dielectric, an outer conductor, and an outer protective sheath, a connector box comprising a shell formed by progressive stamping from sheet metal stock and bent to the form of an open box with a floor and a side wall perpendicular thereto, said shell side wall having a free standing edge away from said floor, a spacer structure made of dielectric material and fitted within said shell, said spacer including a wall adjacent said shell wall, an inner connector element formed by progressive stamping from sheet metal stock, supported by said spacer structure within said shell without making electrical contact with said shell, and providing a wall perpendicular to said floor, said inner connector wall having a free standing edge away from said floor, said shell having insulation displacing slots in said shell wall entering from the free standing edge thereof and sized to cut through the sheath of said cable and engage the outer conductor of said cable, said spacer structure having passages in its wall for receiving said cable, said passages being aligned with said shield insulation displacement slots, and said inner connector having insulation displacing slots in said inner connector wall entering from the free standing edge thereof and sized to cut through said inter-conductor dielectric and engage said inner conductor, said inner connector slots being aligned with said shell slots and said passages.

4. A connector box as claimed in claim 3, said shell wall insulation displacing slots having a portion bounded by an inward turned edge of said shell wall.

5. A connector box as claimed in claim 3, said side wall being made from a plurality of sections bent up from said floor, said sections being held in position with respect to one another by tabs extending from one section and bent around another.

6. A connector box as claimed in claim 3, wherein said spacer structure is made of material with a dielectric constant equal to that of the cable inter-conductor dielectric, said passages being stepped with an inward portion smaller than an outward portion, said outward portion being sized to receive said sheath and said inward portion being sized to receive said inter-conductor dielectric but not said sheath, said spacer structure providing a lip portion defining said passage inward portion, said lip portion thickness being equal to the resultant thickness of the cable inter-conductor dielectric.

7. A connector as claimed in claim 6, wherein said spacer structure has a bottom with thickness equal to that of said spacer structure lip portion.

8. A connector as claimed in claim 6, wherein said inner connector is retained within said spacer spaced from said shell and from said cover by a distance equal to the resultant thickness of the inter-conductor dielectric.

9. A connector box as claimed in claim 3, said passage being stepped with an inward portion smaller than an outward portion, said outward portion being sized to receive said sheath and said inward portion being sized to receive said inter-conductor dielectric but not said sheath.

10. A connector box as claimed in claim 9, said shell wall insulation displacing slots having a portion bounded by an inward turned edge of said shell wall.

11. A connector box as claimed in claim 9, said side wall being made from a plurality of sections bent up from said floor, said sections being held in position with respect to one another by tabs extending from one section and bent around another.

12. A connector box as claimed in claim 9, said shell wall insulation displacing slots having a vee-shape entering section opening to said shell wall free standing edge.

13. A connector box as claimed in claim 12, said inner connector wall insulation displacing slots having a vee-shape entrance portion opening to said inner connector wall free standing edge.

14. A connector box as claimed in claim 12, said shell vee-shaped portion being bounded by sharp edges of said shell wall.

15. A connector box as claimed in claim 9, including a cover held in place in its assembled position by tabs extending from said shell wall and bent over said cover.

16. A connector box as claimed in claim 15, said cover including a cable retaining portion extending toward said floor for holding an attached cable in place.

17. A connector box as claimed in claim 3, said shell wall insulation displacing slots having a vee-shape entering section opening to said shell wall free standing edge.

18. A connector box as claimed in claim 17, said inner connector wall insulation displacing slots having a vee-shape entrance portion opening to said inner connector wall free standing edge.

19. A connector box as claimed in claim 17, said shell vee-shaped portion being bounded by sharp edges of said shell wall.

20. A connector box as claimed in claim 3, including a cover held in place in its assembled position by tabs extending from said shell wall and bent over said cover.

21. A connector box as claimed in claim 20, said cover including a cable retaining portion extending toward said floor for holding an attached cable in place.

* * * * *